US008829747B2

(12) United States Patent
Watanabe et al.

(10) Patent No.: US 8,829,747 B2
(45) Date of Patent: Sep. 9, 2014

(54) ELECTRIC COMPRESSOR FOR CAR AIR CONDITIONING

(75) Inventors: Takayuki Watanabe, Aichi (JP); Takayuki Hagita, Aichi (JP); Masayuki Ishikawa, Aichi (JP); Minoru Kawada, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 257 days.

(21) Appl. No.: 12/992,007

(22) PCT Filed: Oct. 10, 2008

(86) PCT No.: PCT/JP2008/068432
§ 371 (c)(1),
(2), (4) Date: Nov. 10, 2010

(87) PCT Pub. No.: WO2010/041329
PCT Pub. Date: Apr. 15, 2010

(65) Prior Publication Data
US 2011/0062809 A1 Mar. 17, 2011

(51) Int. Cl.
*F04B 35/04* (2006.01)

(52) U.S. Cl.
CPC ..... *F04B 35/04* (2013.01); *F04B 37/121* (2013.01)
USPC ..... 310/71

(58) Field of Classification Search
CPC ..... H02K 5/225
USPC ..... 310/71
See application file for complete search history.

(56) References Cited

U.S. PATENT DOCUMENTS 6,276,969 B1 * 8/2001 Unno et al. ..... 439/620.26
6,441,311 B2 * 8/2002 Fukumoto et al. ..... 174/138 F
(Continued)

FOREIGN PATENT DOCUMENTS

JP 61-113385 U 7/1986
JP 5-135830 A 6/1993
(Continued)

OTHER PUBLICATIONS

JP 05-061474 Machine Translation, Jun. 3, 2012.*
(Continued)

*Primary Examiner* — John K Kim
*Assistant Examiner* — Thomas Truong
(74) *Attorney, Agent, or Firm* — Westerman, Hattori, Daniels & Adrian, LLP

(57) ABSTRACT

Provided is an electric compressor for car air conditioning that allows insulation and airtightness to be ensured at a terminal part thereof. Provided are an opening (111) through which a motor section in a casing communicates with a control section; an insulating terminal (112) closing off the opening (111); a plurality of first wires (131) arranged substantially on a straight line, penetrating the insulating terminal (112), and extending toward the motor section and the control section; a plurality of second wires electrically connected to at least one of the motor section and the control section; plate-shaped male terminals (122) electrically connected to one of the first wires (131) and the second wires; and female terminals electrically connected to the other of the first wires (131) and the second wires, each including a plate portion extending in a plate shape and securing portions disposed at both ends of the plate portion, the male terminals (122) being secured between the plate portions and the securing portions, and the male terminals (122) and the plate portions of the female terminals are disposed so as to extend across the straight line at an acute or obtuse angle.

1 Claim, 4 Drawing Sheets

(56) References Cited

U.S. PATENT DOCUMENTS

| | | | | |
|---|---|---|---|---|
| 6,641,417 | B2 * | 11/2003 | Tanaka et al. | 439/205 |
| 7,197,892 | B2 * | 4/2007 | Ioi et al. | 62/508 |
| 2007/0138882 | A1 * | 6/2007 | Tsukashima et al. | 310/71 |

FOREIGN PATENT DOCUMENTS

| | | | |
|---|---|---|---|
| JP | 5-061474 | U | 8/1993 |
| JP | 5-87838 | U | 11/1993 |
| JP | 2005-180292 | A | 7/2005 |
| JP | 2006-233820 | A | 9/2006 |
| JP | 2007-128756 | A | 5/2007 |

OTHER PUBLICATIONS

JP 2006-233820 Machine Translation, Jun. 3, 2012.*

Dictionary.com, Definition of term "wire", Jan. 30, 2013.*

International Search Report of PCT/JP2008/068432, mailing date Dec. 9, 2008.

Japanese Office Action dated Oct. 2, 2012, issued in corresponding Japanese Patent Application No. 2007-259161, (5 pages). With English Translation.

Decision of Patent dated Mar. 12, 2013, issued in corresponding Japanese Patent Application No. 2007-259161, with Partial translation (4 pages).

* cited by examiner

ELECTRIC COMPRESSOR FOR CAR AIR CONDITIONING

TECHNICAL FIELD

The present invention relates to electric compressors for car air conditioning.

BACKGROUND ART

Conventionally, in inverter-integrated electric compressors for vehicle use, a motor for driving a compressor section is disposed in a pressure container, and consequently a terminal for externally supplying the motor with power is required to ensure the airtightness of the pressure container in addition to insulation.

Therefore, to ensure the insulation and airtightness required for the terminal, various terminals have been proposed (see, for example, Patent Citations 1 and 2).

PATENT CITATION 1

Japanese Unexamined Patent Application, Publication No. 2007-128756

PATENT CITATION 2

Japanese Unexamined Patent Application, Publication No. 2005-180292

DISCLOSURE OF INVENTION

For the terminal disclosed in Patent Citation 1 above, a sufficient insulation distance can be ensured between the terminal and the pressure container by forming a wide opening in a terminal attachment portion of the pressure container. However, a problem arises in that the terminal is disadvantageous in view of ensuring sufficient terminal strength and size reduction because the pressure-receiving area of a plate portion of the terminal is increased.

For the terminal disclosed in Patent Citation 2 above, the pressure-receiving area of the plate portion of the terminal can be reduced to ensure sufficient terminal strength by forming a narrow opening in the terminal attachment portion of the pressure container. However, it may be impossible to ensure a sufficient insulation distance between the terminal and the pressure container and therefore to ensure insulation.

An object of the present invention, which has been made to solve the above problems, is to provide an electric compressor for car air conditioning that allows insulation and airtightness to be ensured at a terminal part thereof.

To achieve the above object, the present invention provides the following solutions.

The present invention provides an electric compressor for car air conditioning including a motor section disposed inside a casing; a control section disposed outside the casing; an opening through which the motor section in the casing communicates with the control section; an insulating terminal closing off the opening; a plurality of first wires arranged substantially on a straight line, penetrating the insulating terminal, and extending toward the motor section and the control section; a plurality of second wires electrically connected to at least one of the motor section and the control section; plate-shaped male terminals electrically connected to one of the first wires and the second wires; and female terminals electrically connected to the other of the first wires and the second wires, each including a plate portion extending in a plate shape and securing portions disposed at both ends of the plate portion, the male terminals being secured between the plate portions and the securing portions, and the male terminals and the plate portions of the female terminals are disposed so as to extend across the straight line at an acute or obtuse angle.

According to the present invention, the male terminals and the plate portions of the female terminals extend across the straight line described above at an acute or obtuse angle, so that a reduction in the opening area of the opening and a reduction in the length along the straight line described above can both be achieved while ensuring the insulation distance between the male terminals and the female terminals and the opening.

In this way, by reducing the opening area of the opening, it is possible to reduce the area where a pressure fluid in the casing and the insulating terminal are in contact, that is, the pressure-receiving area. In addition, by reducing the length along the straight line described above, it is possible to reduce the arrangement interval between securing members for securing the insulating terminal to the casing.

For example, if the male terminals and the plate portions of the female terminals are disposed so as to extend in a direction substantially perpendicular to the straight line described above, it is possible to reduce the length of the opening along the straight line described above, but not to reduce the opening area.

On the other hand, if the male terminals and the plate portions of the female terminals are disposed so as to extend substantially parallel to the straight line described above, it is possible to reduce the opening area of the opening, but not to reduce the length along the straight line described above.

In addition, the male terminals are disposed between the plate portions and the securing portions of the female terminals to bring the female terminals into contact with the male terminals. That is, the male terminals are electrically connected to the female terminals, and accordingly the first wires are electrically connected to the second wires.

Because the male terminals and the plate portions of the female terminals are disposed so as to extend across the straight line at an acute or obtuse angle, the electric compressor for car air conditioning of the present invention provides the advantage of allowing insulation and airtightness to be ensured around the male terminals, the female terminals, and the insulating terminal.

EXPLANATION OF REFERENCE

Figure 1:
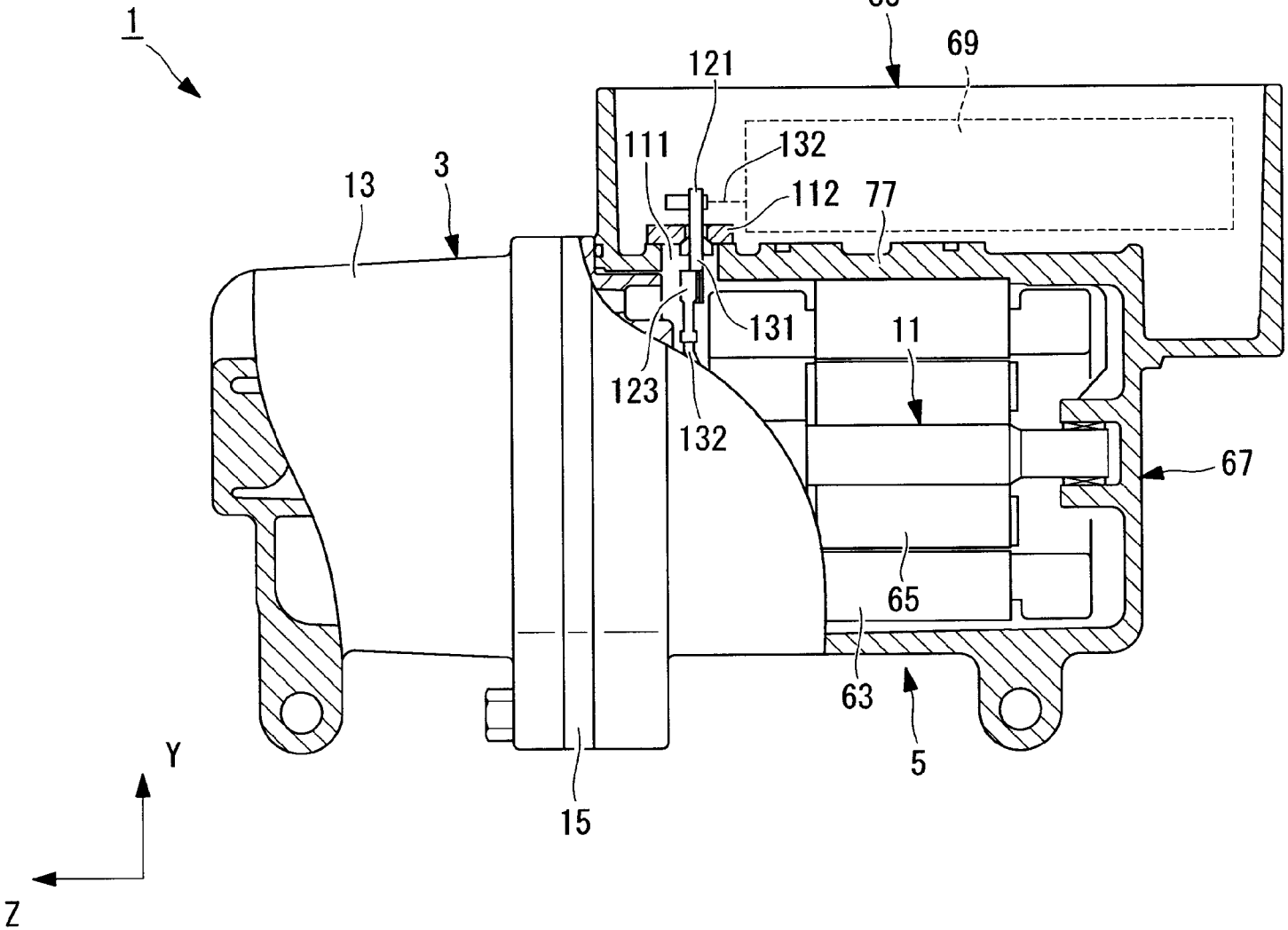
FIG. 1 is a sectional view schematically illustrating the structure of an electric compressor according to an embodiment of the present invention.

1: electric compressor (electric compressor for car air conditioning)

5: motor section
67: motor case (casing)
69: inverter section (control section)
77: cylinder (casing)
111: opening
112: insulating terminal
122: male terminal
123: female terminal
121: terminal portion
131: first wire
132: second wire
125: plate portion
126: securing portion

BEST MODE FOR CARRYING OUT THE INVENTION

An electric compressor according to an embodiment of this invention will now be described with reference to FIGS. 1 to 7.

FIG. 1 is a sectional view schematically illustrating the structure of an electric compressor according to an embodiment of the present invention.

Described in this embodiment is an electric compressor (electric compressor for car air conditioning) 1 applied to an electric compressor which is used in a car air conditioner and whose driving rotational speed is controlled by an inverter.

As shown in FIG. 1, the electric compressor 1 includes a scroll compressor section 3 for compressing a refrigerant used for a car air conditioner and a motor section 5 for driving the scroll compressor section 3.

The scroll compressor section 3 includes a fixed scroll (not shown) and an orbiting scroll (not shown) for compressing the refrigerant, a main shaft 11 for transferring the rotational driving force of the motor section 5 to the orbiting scroll, a housing 13 accommodating the fixed scroll and the orbiting scroll, and an upper bearing case 15 supporting the main shaft 11.

The motor section 5 includes a stator 63 and a rotor 65 for driving the orbiting scroll, a motor case (casing) 67 accommodating the stator 63 and the rotor 65, and an inverter section (control section) 69 for controlling the AC current supplied to the stator 63.

The stator 63 rotates the rotor 65 by forming an AC magnetic field on the basis of the AC current supplied from the inverter section 69.

As shown in FIG. 1, the motor case 67 includes a cylindrical cylinder (casing) 77 accommodating the stator 63 and the rotor 65 and a box 83 accommodating the inverter section 69.

The box 83 accommodates the inverter section 69. The box 83 is open outward in the radial direction of the cylinder 77.

Figure 2:
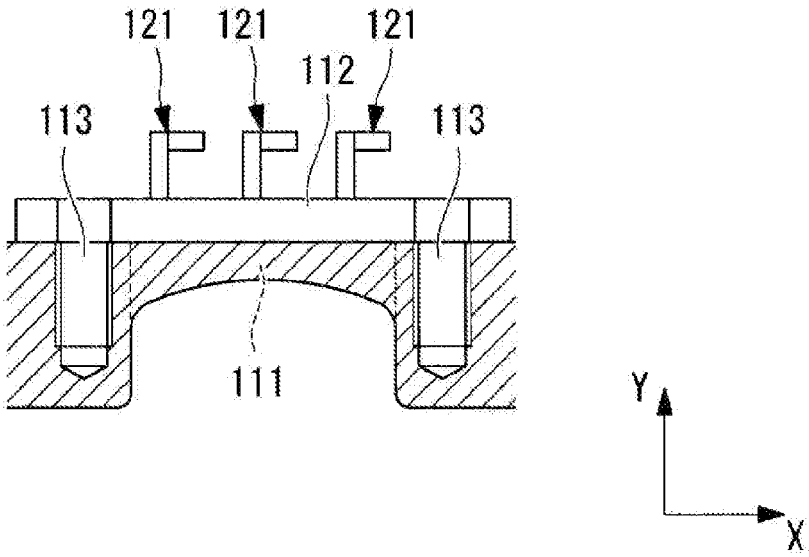
FIG. 2 is a sectional view illustrating the structure of a portion of a motor case in FIG. 1 to which an insulating terminal is attached.
Figure 3:
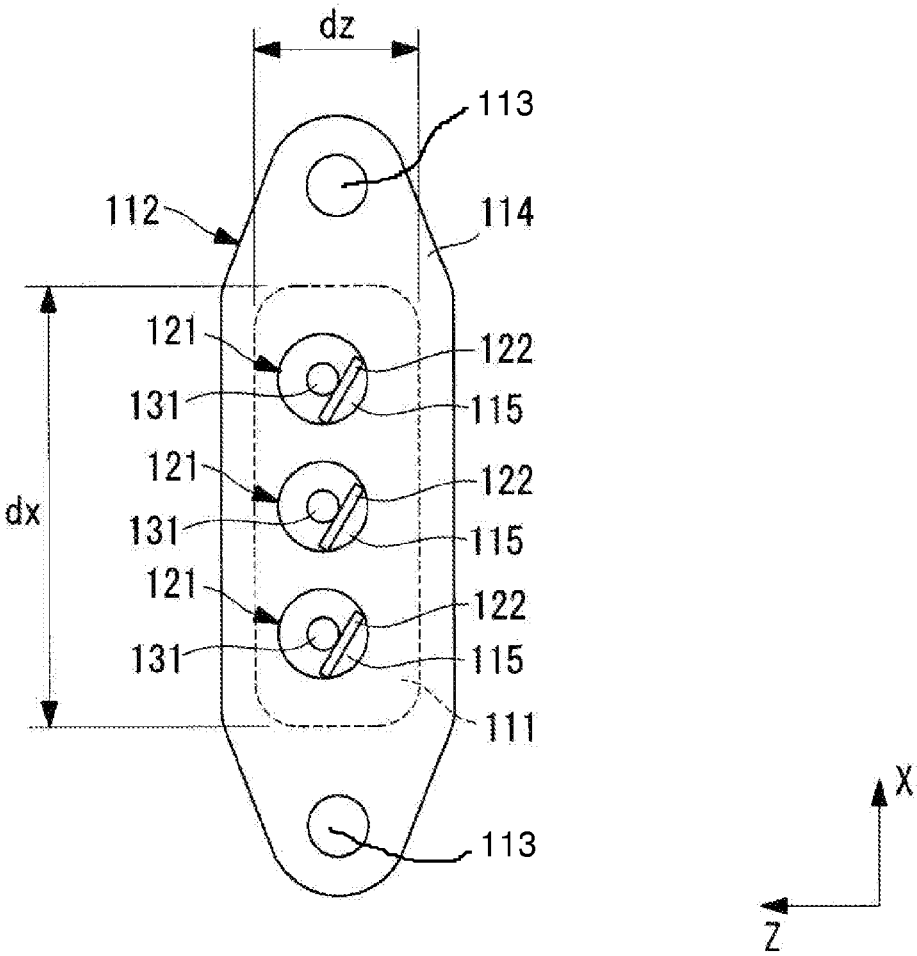
FIG. 3 is a top view illustrating the structure of the insulating terminal in FIG. 2.

FIG. 2 is a sectional view illustrating the structure of a portion of the motor case in FIG. 1 to which an insulating terminal is attached. FIG. 3 is a top view illustrating the structure of the insulating terminal in FIG. 2.

As shown in FIGS. 1 to 3, the cylinder 77 has an opening 111 for connecting the inverter section 69 to the motor section 5.

An insulating terminal 112 is disposed over the opening 111. The insulating terminal 112 is formed by integrating a metal plate 114 serving as a pressure-resistant structure with first wires 131 penetrating the metal plate 114 and serving as pins for electrically connecting the motor section 5 to the inverter section 69, using a vitrified material. The vitrified material is disposed between the metal plate 114 and the first wires 131 to insulate the metal plate 114 from the first wires 131.

Insulators 115 are disposed between the metal plate 114 and male terminals 122 on the surface of the insulating terminal 112 opposite the motor section 5 (the lower surface in FIG. 3). The insulators 115 are members formed in a substantially cylindrical shape using an insulating material, and the first wires 131 are inserted inside the insulators 115. In addition, the insulating terminal 112 is disposed so as to close off the opening 111 with securing bolts (not shown) screwed into securing bolt holes 113 formed in the cylinder 77.

The insulating terminal 112 has a plurality of terminal portions 121 constituted by the male terminals 122 and female terminals 123. In this embodiment, an example in which three terminal portions 121 are arranged side by side substantially on a straight line in the diameter direction of the cylinder 77 (the X direction in FIG. 3) will be described.

The opening 111 is formed with such a size that a gap is formed between the opening 111 and the male terminals 122 and the female terminals 123 disposed on the insulating terminal 112. By forming this gap, the insulation between the cylinder 77 and the terminal portions 121 is maintained.

In this embodiment, the dimension of the opening 111 in the X-axis direction is denoted by dx, and the dimension in the Z-axis direction is denoted by dz.

Figure 4:
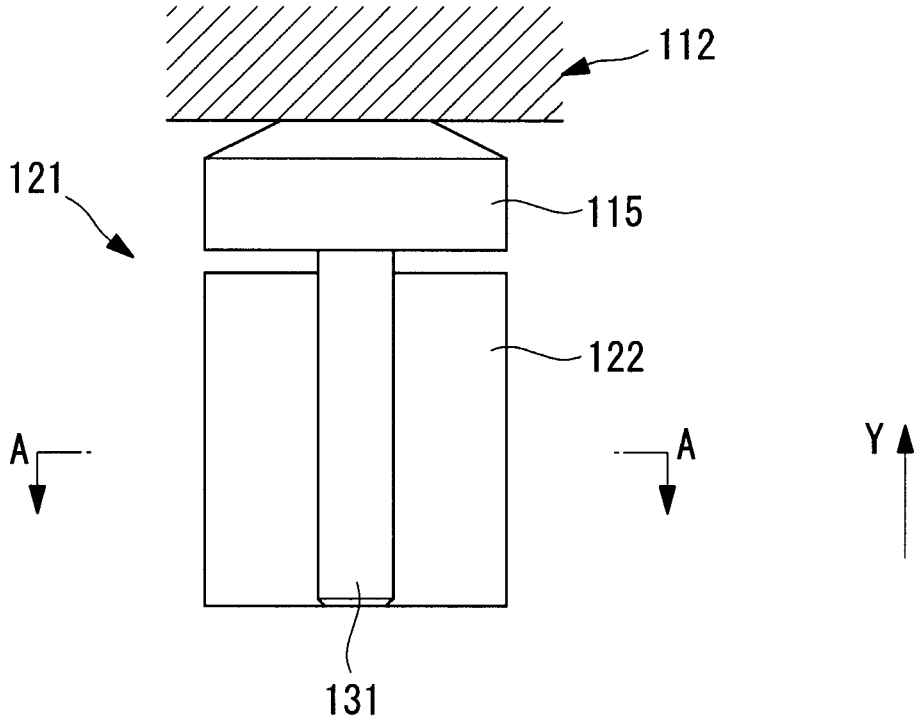
FIG. 4 is a schematic diagram illustrating the structure of a male terminal in a terminal portion in FIG. 2.
Figure 5:
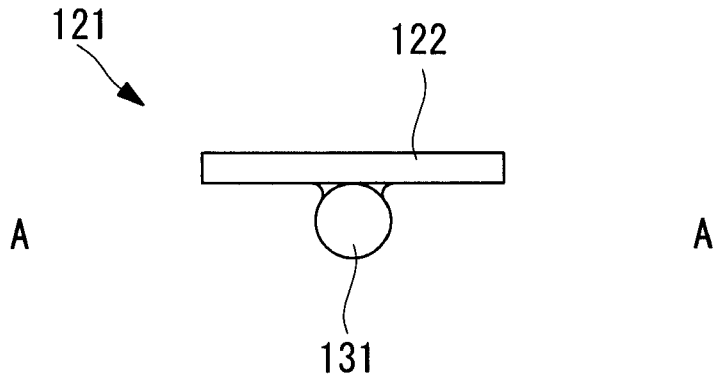
FIG. 5 is a sectional view along A-A illustrating the structure of a male terminal in a terminal portion in FIG. 2.

FIG. 4 is a schematic diagram illustrating the structure of a male terminal in a terminal portion in FIG. 2. FIG. 5 is a sectional view along A-A illustrating the structure of the male terminal in FIG. 4.

As shown in FIGS. 4 and 5, the male terminals 122 of the terminal portions 121 are plate-shaped members attached to the first wires 131, which extend in the Y-axis direction. The male terminals 122 are fixed and electrically connected to at least one of the ends of the first wires 131 on the inverter section 69 side and the ends of the first wires 131 on the motor section 5 side by, for example, welding.

The first wires 131 are conductive members, such as pins, penetrating the insulating terminal 112 and extending toward the inverter section 69 and the motor section 5.

As shown in FIG. 3, the male terminals 122 are disposed so as to be inclined with respect to the longitudinal direction of the main shaft 11 in the electric compressor 1, namely, the Z-axis, so as to be inclined with respect to the X-axis, which is perpendicular to the Z-axis, and so as to extend in the direction perpendicular to the page in FIG. 3, namely, the Y-axis.

Figure 6:
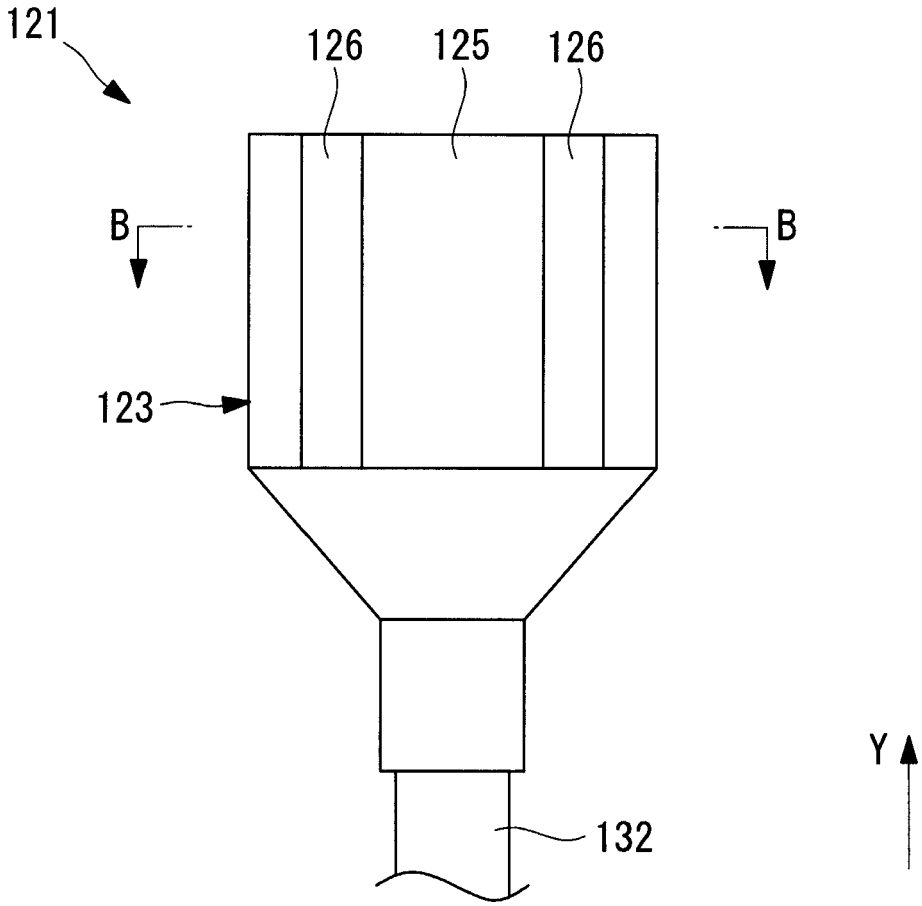
FIG. 6 is a schematic diagram illustrating the structure of a female terminal in a terminal portion in FIG. 2.
Figure 7:
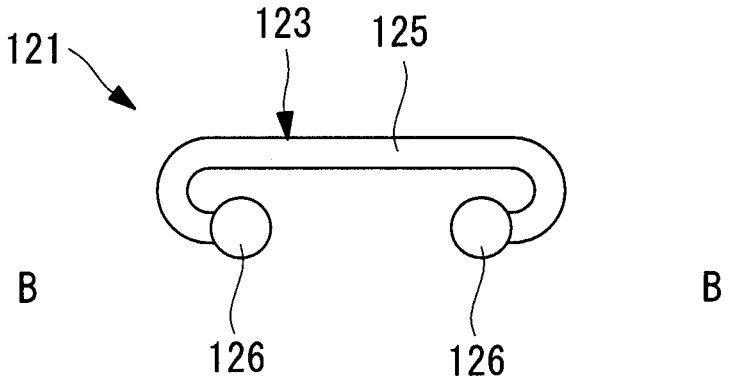
FIG. 7 is a sectional view along B-B illustrating the structure of a female terminal in a terminal portion in FIG. 2.

FIG. 6 is a schematic diagram illustrating the structure of a female terminal in a terminal portion in FIG. 2. FIG. 7 is a sectional view along B-B illustrating the structure of the female terminal in FIG. 6.

As shown in FIG. 6, the female terminals 123 of the terminal portions 121 are attached to second wires 132 extending along the Y-axis and are electrically connected to the second wires 132.

The second wires 132 are wires connected to the inverter section 69 and the motor section 5.

As shown in FIGS. 6 and 7, the female terminals 123 include a plate-shaped plate portion 125 extending along the second wires 132 and securing portions 126 for securing the male terminals 122 between the securing portions 126 and the plate portion 125.

When the female terminals 123 are attached to the male terminals 122, the plate portions 125 are disposed so as to be inclined with respect to the longitudinal direction of the main shaft 11 in the electric compressor 1, namely, the Z-axis, so as to be inclined with respect to the X-axis, which is perpendicular to the Z-axis, and so as to extend in the direction perpendicular to the page in FIG. 3, namely, the Y-axis.

As shown in FIGS. 6 and 7, the securing portions 126 are members formed by bending the two ends of the plate portion 125 so that they become elastic. The example shown in FIG. 6 is securing portions 126 formed by bent portions extending along the Y-axis.

By forming the securing portions 126 in this way, the male terminals 122 can be slid between the plate portions 125 and the securing portions 126 of the female terminals 123 in the direction along the Y-axis to electrically connect the male terminals 122 to the female terminals 123.

In addition, because the securing portions 126 are elastic, the male terminals 122 can be easily secured between the plate portions 125 and the securing portions 126.

As described above, it is possible to dispose the male terminals 122 at the first wires 131 and the female terminals 123 at the second wires 132, or conversely, it is possible to dispose the female terminals 123 at the first wires 131 and the male terminals 122 at the second wires 132; it is not particularly limited.

Next, the compression of a refrigerant in the electric compressor 1 according to this embodiment will be described.

As shown in FIG. 1, a DC current supplied from outside the inverter is subjected to frequency control by an electronic device such as a power transistor in the inverter section 69 and is then supplied to the motor section 5.

In the motor section 5, the stator 63 forms an AC magnetic field on the basis of the frequency-controlled AC current. The rotor 65 causes a rotational driving force through interaction with the formed AC magnetic field. The rotational driving force caused by the rotor 65 is transferred to the main shaft 11.

The rotational driving force is transferred to the orbiting scroll via the main shaft 11. The orbiting scroll is then driven to orbit while being prevented from rotating by a rotation-preventing portion.

As the orbiting scroll is driven to orbit, the compression chamber formed between the orbiting scroll and the fixed scroll takes in and compresses the refrigerant. Specifically, the compression chamber takes in the refrigerant at the circumferential ends of the fixed scroll and the orbiting scroll. The refrigerant taken in is then compressed as the orbiting scroll orbits.

The refrigerant compressed in the compression chamber is discharged outside the housing 13.

In the above configuration, the male terminals 122 and the plate portions 125 of the female terminals 123 extend across the straight line described above at an acute or obtuse angle, so that a reduction in the opening area of the opening 111 and a reduction in the length along the straight line described above can both be achieved while ensuring the insulation distance between the male terminals 122 and the female terminals 123 and the opening 111.

In this way, by reducing the opening area of the opening 111, it is possible to reduce the area where the refrigerant in the cylinder 77 and the insulating terminal 112 are in contact, that is, the pressure-receiving area. In addition, by reducing the length along the straight line described above, it is possible to reduce the arrangement interval between the securing bolts, serving as securing members for securing the insulating terminal 112 to the casing. That is, it is possible to ensure insulation and airtightness at the terminal part of the electric compressor 1 of this embodiment.

For example, if the male terminals 122 and the plate portions 125 of the female terminals 123 are disposed so as to extend in a direction substantially perpendicular to the straight line described above, it is possible to reduce the length of the opening 111 along the straight line described above, but not to reduce the opening area.

On the other hand, if the male terminals 122 and the plate portions of the female terminals 123 are disposed so as to extend substantially parallel to the straight line described above, it is possible to reduce the opening area of the opening 111, but not to reduce the length along the straight line described above.

In addition, the male terminals 122 are disposed between the plate portions 125 and the securing portions 126 of the female terminals 123 to bring the female terminals 123 into contact with the male terminals 122. That is, the male terminals 122 are electrically connected to the female terminals 123, and accordingly the first wires can be electrically connected to the second wires 132.

The invention claimed is:

1. An electric compressor for car air conditioning, comprising:

a motor section disposed inside a casing;

a control section disposed outside the casing;

an opening through which the motor section in the casing communicates with the control section;

an insulating terminal closing off the opening, the insulating terminal having two securing bolt holes and being fastened with two bolts;

a plurality of first wires arranged substantially on a plane which aligns with the centers of the two securing bolt holes, the plurality of first wires penetrating the insulating terminal, and extending toward the motor section and the control section;

a plurality of second wires electrically connected to at least one of the motor section and the control section;

plate-shaped male terminals electrically connected to one of the first wires and the second wires; and female terminals electrically connected to an other of the first wires and the second wires, each including a plate portion extending in a plate shape and securing portions disposed at both ends of the plate portion, the male terminals being secured between the plate portions and the securing portions;

wherein the male terminals are disposed so as to extend across the plane at an acute or obtuse angle.

* * * * *